United States Patent [19]

Heaps, Jr.

[11] Patent Number: 4,949,872

[45] Date of Patent: Aug. 21, 1990

[54] STACKABLE FLUENT MATERIAL CONTAINER

[75] Inventor: Harry D. Heaps, Jr., Villanova, Pa.

[73] Assignee: Connelly Containers, Inc., Bala-Cynwyd, Pa.

[21] Appl. No.: 334,880

[22] Filed: Apr. 7, 1989

Related U.S. Application Data

[63] Continuation-in-part of Ser. No. 332,375, Mar. 31, 1989, Pat. No. 4,919,306, which is a continuation of Ser. No. 149,920, Jan. 25, 1988, abandoned, which is a continuation-in-part of Ser. No. 994,502, Dec. 17, 1986, Pat. No. 4,771,917.

[51] Int. Cl.[5] ..... B65D 37/00

[52] U.S. Cl. ..... 222/105; 220/462; 220/403; 222/183; 222/143; 383/33

[58] Field of Search ..... 222/105, 143, 183, 386.5, 222/181, 185; 220/403, 404, 462, 465, 461, 1.5, 69; 383/33, 34, 34.1

[56] References Cited

U.S. PATENT DOCUMENTS

| | | | |
|---|---|---|---|
| 2,511,481 | 6/1950 | Schneider | 220/404 X |
| 2,654,892 | 10/1953 | Szabo | 383/33 X |
| 3,096,912 | 7/1963 | Rivette | 222/105 X |
| 3,233,817 | 2/1966 | Casady | 220/403 |
| 3,265,254 | 8/1966 | Carter et al. | 222/143 X |
| 3,279,657 | 10/1966 | Rousselet | 222/183 |
| 3,433,400 | 3/1969 | Hawkins | 222/183 X |
| 3,777,938 | 12/1973 | Nikowitz et al. | 222/105 X |
| 3,940,052 | 2/1976 | McHugh | 220/404 |
| 4,173,288 | 11/1979 | Schultz | 220/462 X |
| 4,426,015 | 1/1984 | Preston et al. | 220/403 |
| 4,524,883 | 6/1985 | Herring | 220/462 |
| 4,585,143 | 4/1986 | Freman et al. | 222/105 X |
| 4,735,239 | 4/1988 | Salmon et al. | 222/105 X |

FOREIGN PATENT DOCUMENTS

| | | | |
|---|---|---|---|
| 3016466 | 11/1980 | Fed. Rep. of Germany | 220/403 |
| 2395913 | 3/1979 | France | 220/403 |

*Primary Examiner*—Kevin P. Shaver

*Attorney, Agent, or Firm*—Mason, Fenwick & Lawrence

[57] ABSTRACT

A stackable container for holding large quantities of fluent material comprises an outer load-bearing multi-layer corrugated paperboard wall and an inner liquid-impervious bag. A plate with an opening through it is supported on a peripheral ledge slightly below the top of the container wall. The ledge is provided by the upper edge of one or more inner layers of the container wall. The mouth of the bag extends upwardly through the opening in the plate and is secured by a strap to a bag holder on the plate. A load transmitting member on the upper surface of the plate is of substantially the same thickness as the ledge, and extends to the same height as the outer layer of the wall. The bag holder is a ring, larger than portions of the opening in the plate and may be passed transversely through the opening but not when parallel to the plate.

16 Claims, 4 Drawing Sheets

STACKABLE FLUENT MATERIAL CONTAINER

This application is a continuation-in-part of application Ser. No. 332,375 filed Mar. 31, 1989 now U.S. Pat. No. 4,919,306 which is a continuation application of application Ser. No. 149,920 filed Jan. 25, 1988, now abandoned which is a continuation-in-part of application Ser. No. 994,502 filed Dec. 17, 1986, now U.S. Pat. No. 4,771,917.

BACKGROUND OF THE INVENTION

The present invention relates to a container for fluent material.

Containers for fluent material generally have an outer load bearing shell, commonly made of corrugated paperboard such as doublewall board and/or triplewall board. This material is of substantial strength, is economical and is widely used, the particular corrugated board and the number of layers being selected to provide the required strength. Within the outer corrugated board shell, there is a bag made of flexible material which is impervious to liquid or other fluent material which is to be contained and transported. These bags are typically of a suitable plastic, such as polyvinyl chloride. Containers of this type are typically used for the shipment of large quantities and weights of fluent material. For example, known containers of this type will hold three hundred gallons of liquid, the weight of which will be approximately 2,800 pounds. Such containers are placed on wooden pallets to enable then to be readily moved.

Heaps et al U.S. Pat. No. 4,771,917 provides a container of this type in which a filling spout at the upper end of the bag is supported by a plate extending horizontally near the upper end of the container, the plate resting on the coplanar upper edges of an inner and an intermediate layer forming part of the wall of the container.

An alternate construction is disclosed in the above mentioned application of Heaps, et al Ser. No. 149,920, in which a ring is provided to which the mouth portion of the bag is secured, the ring being substantially large in diameter, such as approximately fifteen inches, in order to permit rapid filling of the bag. The ring rests on the upper surface of the plate, which is supported near the top of the container, the bag mouth portion extending upwardly through the opening in the plate. Since the bag mouth portion is secured to the ring, the bag is held by the ring, supported on the plate, during filling. A closure is applied to the bag and ring after filling of the bag. This construction, while providing a container capable of rapid filling, did not permit stacking of one container on another. Further, the construction specifically disclosed for joining the bag to the bag supporting ring required the utilization of special equipment not available at plants which produce corrugated paperboard and containers from them. Nor is such equipment available to the users of such containers with bags, these being the producers of fluent material such as liquids, tomato paste, powders etc.

Containers of various types are produced by container manufacturing plants, and are conventionally shipped in knock-down and disassembled condition to a customer. The customer then erects the container, and assembles the various parts of it, including the liquid impervious bag. To provide a container as disclosed in said Heaps et al application, there was produced a sub-assembly comprising the bag, bag support and top and bottom plates. To make this sub-assembly, the bag was required to be passed through the opening in the plate, until substantially the entire body of the bag, except for the mouth portion, was on one side of the plate, the bag holding a ring and the mouth portion of the bag which was inseparably secured to it being on the other side of the plate. A bottom plate was then attached to the bottom of the bag. This operation has been found to be more time consuming and somewhat more difficult than is desirable, due to the effort to pass the large bag through the opening.

The above construction was also found to be more expensive than desirable, because of the requirement that the bag be joined to the bag holder, which was in the form of a ring, by specialized forming equipment not conventionally found in corrugated paperboard plants. The construction was therefore expensive due to the necessity for shipping bags to a plant having the specialized equipment and the necessity for the special operations required for joining the bag to the bag holder.

While containers as above described have proven to be highly advantageous in that they could be rapidly filled, and were sufficiently strong to hold the large weights in them, approaching 3000 pounds of liquid, it was found that they were not sufficiently strong to be stacked, despite the fact that the initial testing of components of the container indicated that all parts were sufficiently strong to enable stacking.

SUMMARY OF THE INVENTION

A container including an outer corrugated board shell and an inner liquid impervious bag is provided, the container walls being of multiple layers of corrugated paperboard. An inner layer or layers has an upper edge below the upper edge of the outer layer, providing a supporting ledge for a plate which is thereby supported below the top of the container. The plate has an opening in it, and the bag extends through the opening, the bag being secured to a bag holder which rests on top of the plate. A load transmitter is provided between and engaging the under surface of a closure cap for the container and the plate, the load transmitter extending peripherally within the upper portion of the outer layer, and above the inner layer or layers of the wall of the container. The mouth portion of the bag is attached to a peripherally extending bag holder by a circumferentially extending clamp, such as a plastic strap icorporating a fastener construction for providing a clamping ring.

Further, the bag holder and the opening in the plate are relatively dimensioned and shaped so that the bag holder, which may be of generally ring shape, can be passed transversely through the opening, that is, when the bag holder is in a plane substantially perpendicular to the plane of the plate; the bag holder connot be passed through the opening when it is in a plane sustantially parallel to the plane of the plate.

Among the objects of the present invention are the provision of a container comprising an outer wall and a liquid impervious bag and a plate for supporting the mouth portion of the bag, which container is capable of supporting a similar container stacked thereon.

Another object of the present invention is to provide a container of the above type in which the container wall has substantially uniform column strength from top to bottom of the container.

Still another object of the present invention is to provide a container of the above type having improved column strength and which may be readily assembled.

A further object of the present invention is to provide a container construction in which a bag and a bag holder may be readily assembled without requiring the use of special equipment.

A further object of the invention is to provide a construction of a container with a bag therewithin which may be readily assembled, and in particular, in which a bag, bag holder and supporting plate may be readily assembled.

Other objects and many attendant advantages of the present invention will be readily apparent from the appended drawings, specification and claims.

DESCRIPTION OF THE PREFERRED EMBODIMENTS

Figure 1:
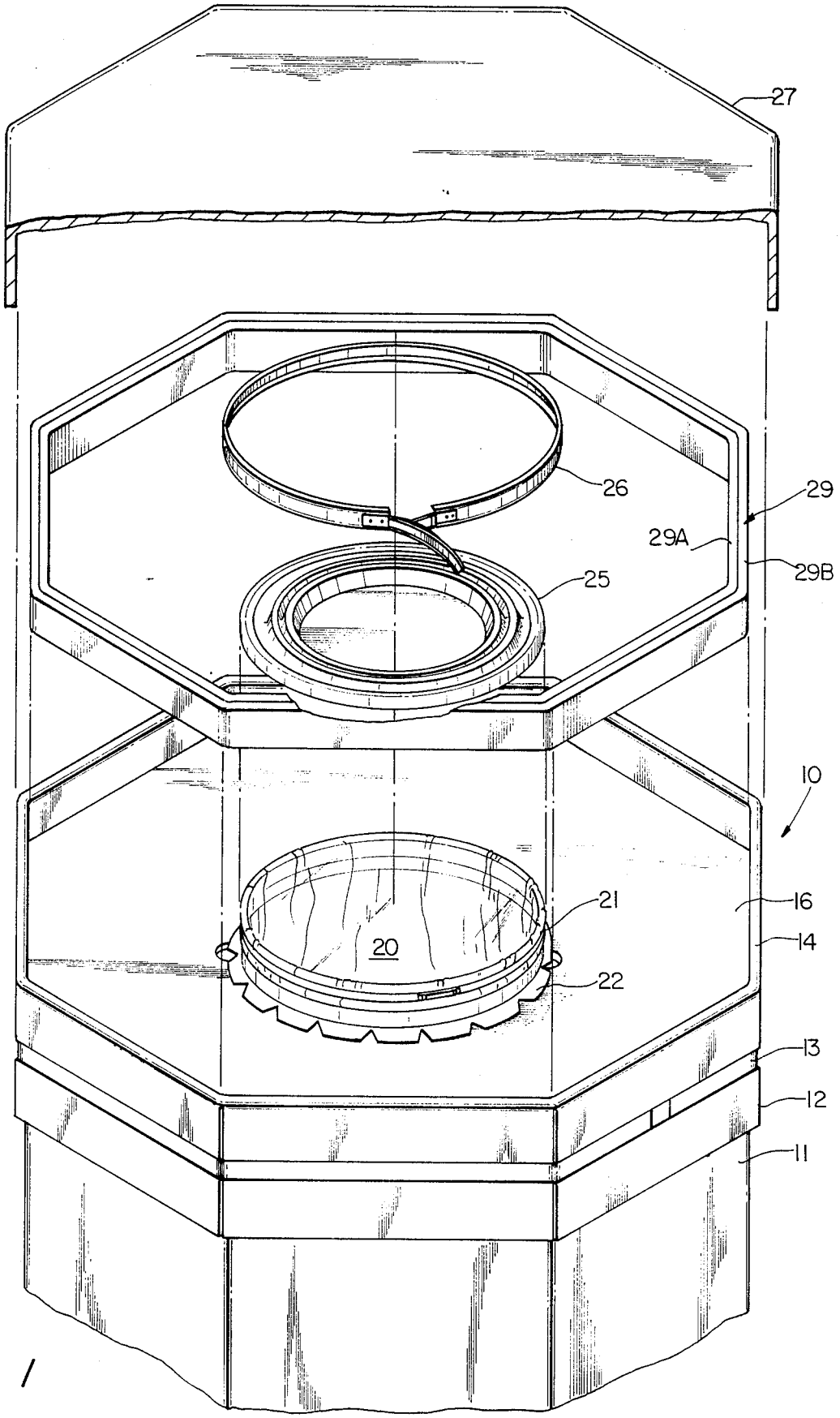
FIG. 1 is an exploded perspective view, with parts in section, of the upper portion of a container in accordance with the present invention.

Referring now to the drawings, wherein like or corresponding reference numerals are used for like or corresponding parts throughout the several views, there is shown in FIG. 1 a container 10 in accordance with the present invention, container 10 including a surrounding wall 11 having flaps 12 held in place by reinforcing strap 13. The top of the wall 11 has an edge 14 which lies in a generally horizontal plane in the normal position of container 10. Container 10 is, as shown, eight sided, and below the upper edge 14 is a octagonal plate 16, the edges of which are in adjoining relationship to the interior surfaces of the eight panels which form the wall 11.

A liquid impervious bag 20 is within the container 10, the upper part of the bag being open and forming a mouth portion 21 which extends through an opening (not shown) in the plate 16. The end of the bag 20 is secured to the upper surface of the plate 16 by adhesive tape 22. A closure 25 is provided for the mouth of the bag 20, and is held in place by a conventional toggle-operated ring 26. A conventional skirted cap 27 octagonal shape is provided, the lower surface of which engages the upper edge 14 of the wall 11. Within wall 11 is a octagonal peripherally extending load transmitting member 29 which is comprised of inner layer 29A and outer layer 29B.

Figure 2:
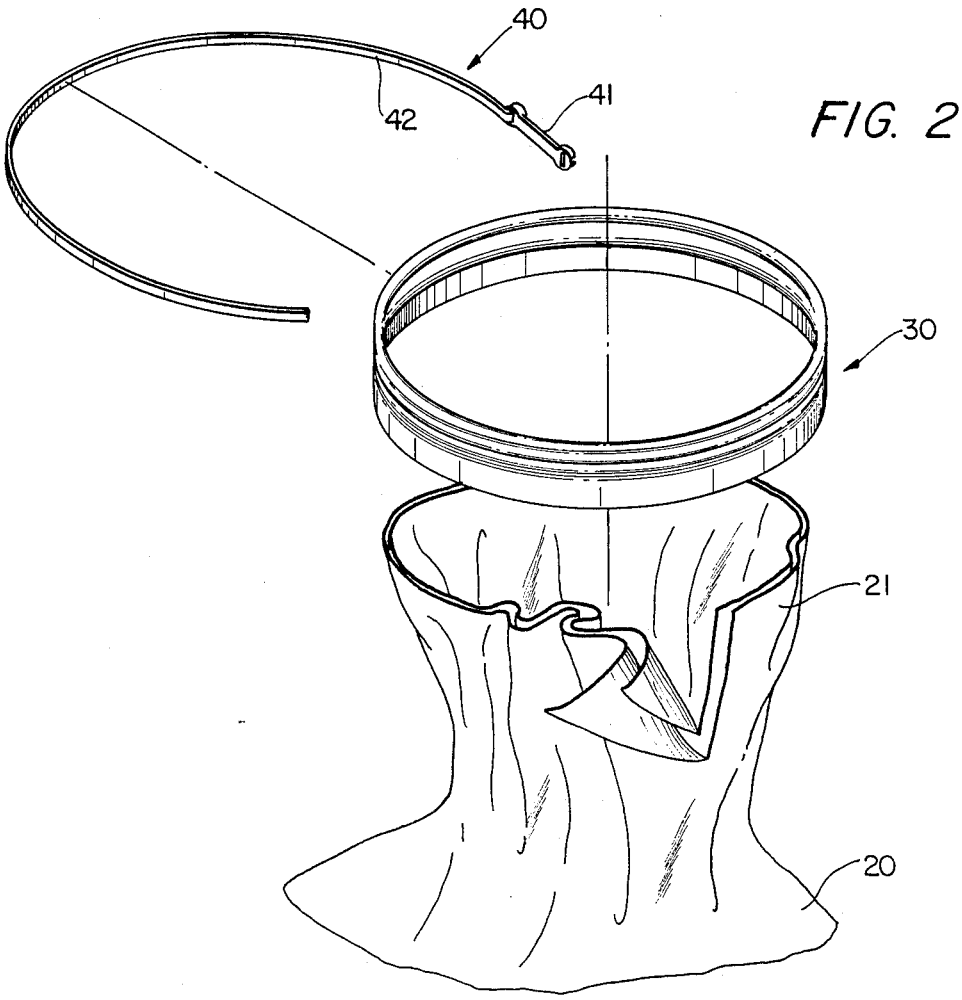
FIG. 2 is an exploded perspective view of a bag and bag holder in accordance with the present invention.

Referring now to FIG. 2, there is shown bag 20 with mouth portion 21. Bag 20 may be a double-layer bag as shown. An annular bag holder 30 is above the bag 20, for reception of the mouth 21 therethrough. A securing strap 40 is provided: it may be, for example, a plastic strap 42 having a connector 41 which receives the two ends of the strap 42 and holds them securely.

Figure 3:
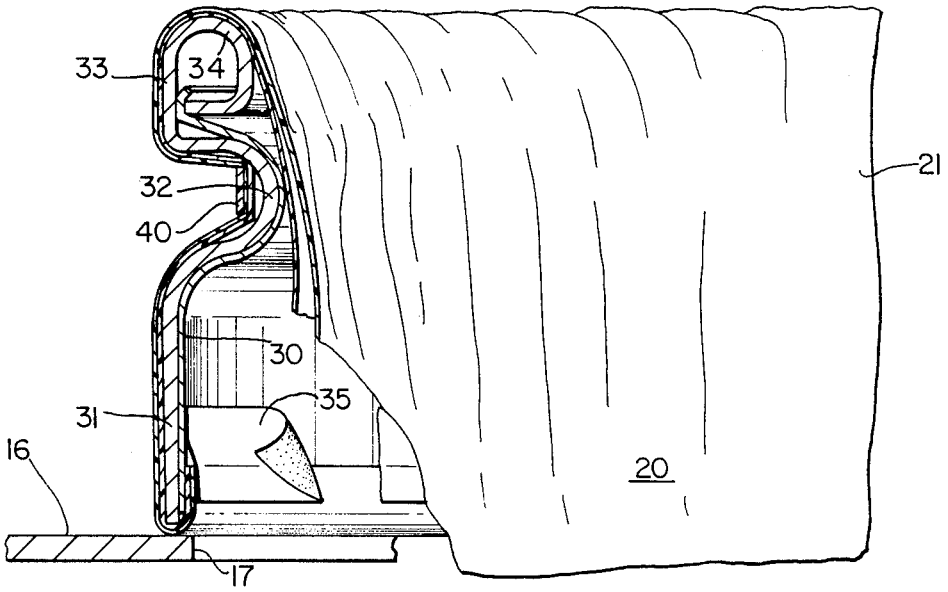
FIG. 3 is an enlarged partial cross-sectional view of the bag and bag holder shown in FIG. 2.

The bag holder 30, as shown in FIG. 3, comprises a lower cylindrical portion 31, an inwardly curved portion 32, an upper cylindrical portion 33, and a re-entrant upper edge 34. The mouth portion 21 of bag 20 is inserted through the opening 17 in plate 16, passed through the bag holder 30, and thence downwardly along the outside of the bag holder 30, the end of the bag being passed upwardly into the bag holder 30 where it is secured by adhesive tape 35. The securing strap 40 is then placed in position, clamping the mouth portion 21 of bag into the inwardly curved portion 32 of bag holder 30.

Figure 4:
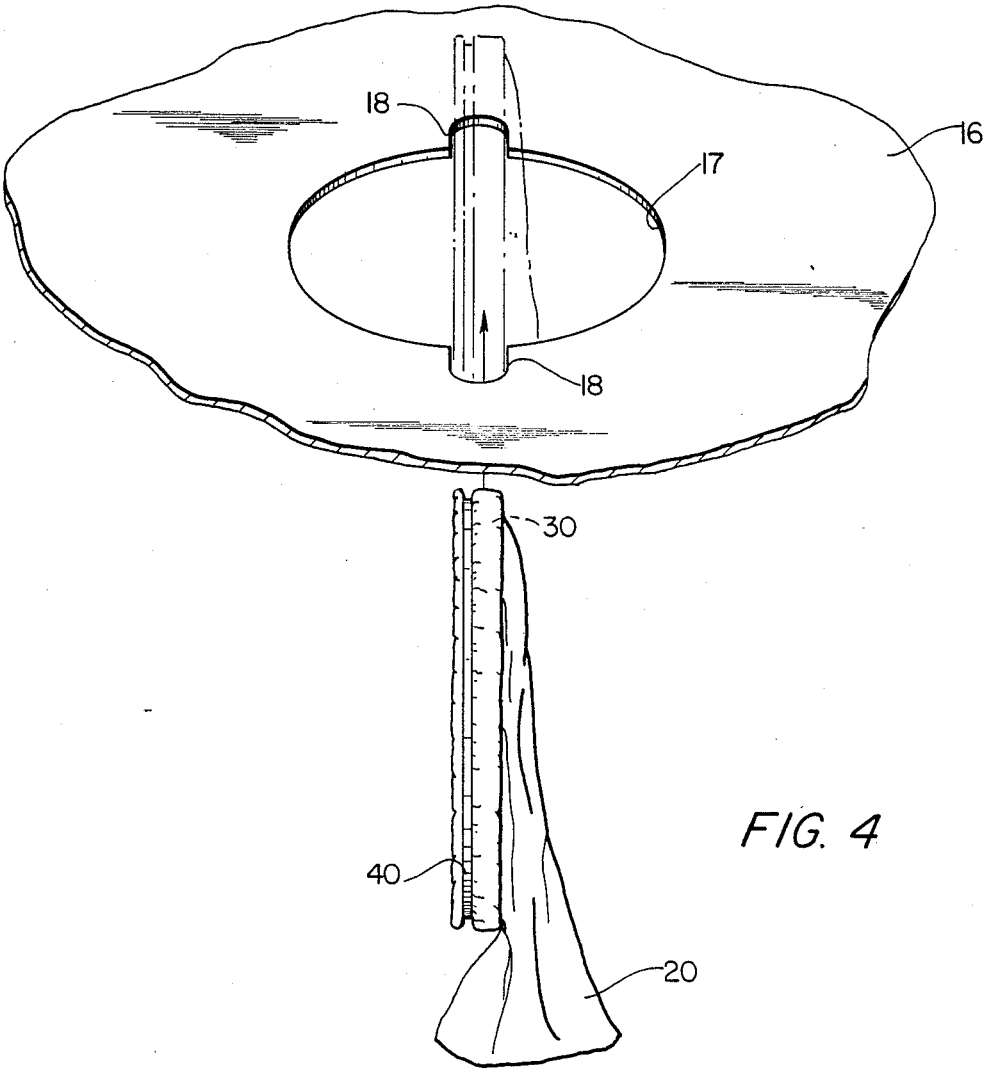
FIG. 4 is an exploded perspective view of a supporting plate, bag and bag holder, in the process of assembly.

As shown in FIG. 4, the bag 20 may be secured to the bag holder 30 by the strap 40, and this subassembly may then be assembled to the plate 16. To facilitate this assembly, plate 16 is provided with an opening 17 which is generally circular, there being in addition a pair of opposed cutouts 18 extending therefrom. Thus, the entire opening has a greater expanse from end to tend of the cutouts 18 than in the direction transverse thereto. The cutouts 18, together with opening 17, provide an opening, from end to end, which is slightly greater than the diameter of the bag holder 30, with the bag 20 secured to it. The width of the cutouts 18 is sufficiently large to permit the bag holder 30, with the attached bag 20, to pass through it, when the plane of the bag holder 30 is substantially perpendicular to the plane of the plate 16. Once the bag holder 30 with the attached bag 20 has passed through the opening 17, 18 in plate 16, it is rotated so that the bag holder then rests on the upper surface of the plate 16, as shown in FIGS. 3 and 5, being parallel to plate 16.

Figure 5:
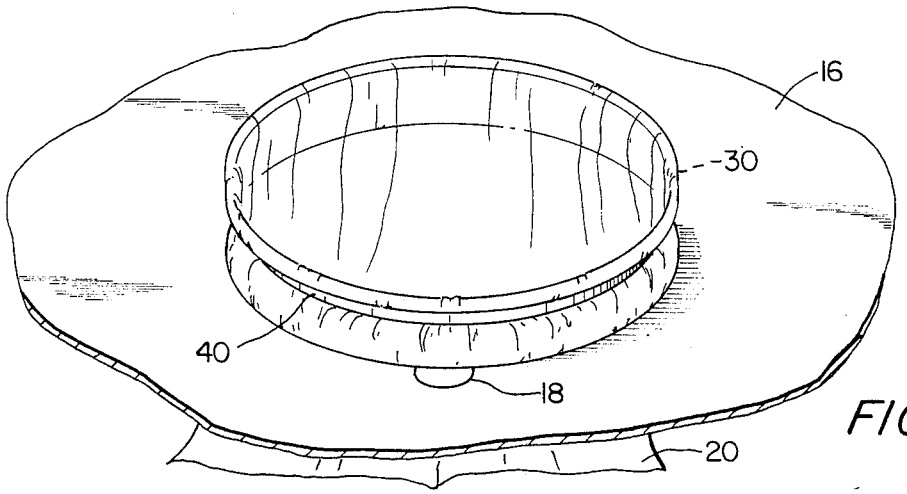
FIG. 5 is a perspective view of a subassembly of the parts shown in FIG. 4, after assembly.

Although there has been disclosed in FIGS. 4 and 5 one specific configuration by which the bag holder 30 may pass transversely through the opening in the plate 16, and be prevented from passing through that opening when parallel to the plate 16, other embodiments within the scope of the disclosure will be readily apparent.

Figure 6:
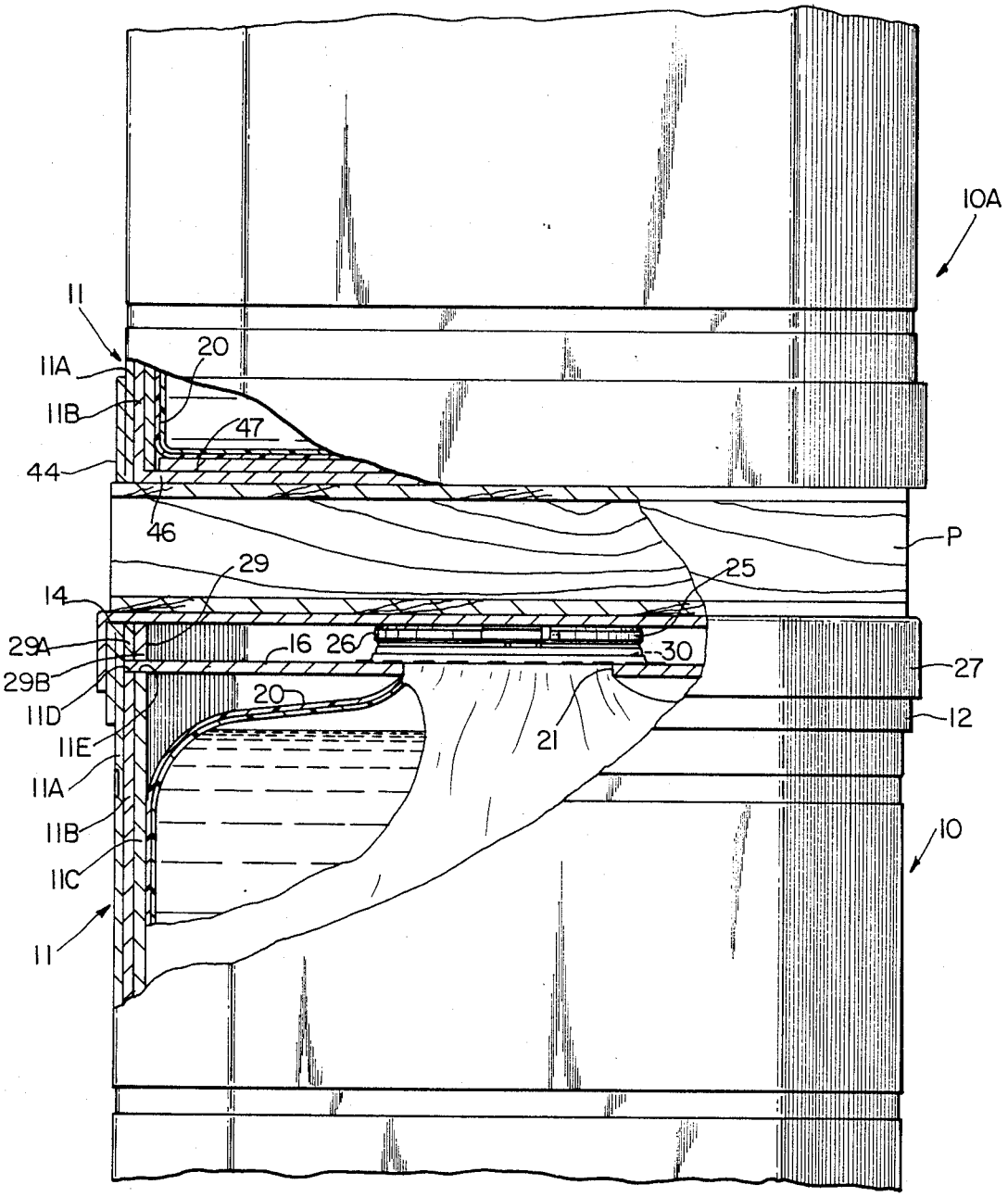
FIG. 6 is an elevational view, with parts in section, of parts of containers in accordance with the present invention in stacked array.

After the assemblage of the bag 20, bag holder 30 and securing strap 40, as shown in FIGS. 3 and 4, and the assembly thereof to the plate 16 in the manner shown in FIG. 4, the bag 20 is attached to a bottom plate (not shown). When container 10 is to be erected and assembled, the bottom plate is dropped into the container, and the plate 16 is supported below the top edge 14. As shown in FIG. 6, the wall 11 comprises outer layer 11A, intermediate layer 11B and an inner layer 11C. These layers are of so-called multi-wall board such as double-wall and/or triplewall corrugated board. Intermediate layer 11B and inner layer 11C have upper edges 11D and 11E, respectively, which are coplanar and below the upper edge 14 of outer layer 11A. The plate 16 rests on the upper edges 11D and 11E, the edges of plate 16 adjoining the inner surface of the outer layer 11A, and is supported by the intermediate layers 11B and 11C. The bag holder 30 provides a large diameter opening for filling of the bag 20, with the bag holder 30 holding the mouth portion 21 open, for the entry of fluent material and/or a filling hose or nozzle, and providing room for the displacement of air from within the bag 20.

The load transmitting member 29 comprises an outer layer 29A which is in substantially engaging contact with the inner surface of the outer layer 11A, and an inner layer 29B. The layers 29A and 29B correspond in thickness and in strength, respectively, to the intermediate layer 11B and inner layer 11C of the wall 11.

After filling the bag 20, the closure 25 is placed on the bag holder 30, with the bag 20 assembled to it, and the toggle operated ring 26 is placed in position and closed, an upper flange thereof overlying bag holder 30 and a lower flange therof entering into the inwardly curved portion 32 thereof.

The outer layer 11A of container wall 11 extends above the plate 16 a substantial distance, in order to support the cap 27 above the closure 25 and ring 26. In practice, this distance is in the order of three inches. The plate 16 is of multi-wall corrugated board approximately one-half inch thick. Consequently the space above the upper surface of the plate 16 is approximately two and one-half inches. The portion of outer layer 11A is of lesser thickness and less column strength than is the wall 11 with multiple layers, below edges 11D and 11E.

A container 10A, substantially identical to the container 10, may be supported by pallet P on container 10. The load thereof, which will be on the order of 2,800–3,000 pounds, is transmitted by the cap 27 to the outer layer 11A, and by the load transmitting member 29 through the periphery of plate 16 and into the intermediate layer 11B and inner layer 11C. The transmission of the load of container 10A into and through wall 11 below plate 16 does not cause significant, i.e. strength-reducing, deformation of cap 27, the portion of outer layer 11A above edges 11D and 11E, load tranmitting member 24 and plate 16. This result is achieved because the load bearing and transmitting structure of container 10 has substantial column strength both above the plate 16 and below the edges 11D and 11E, and the column strength of wall 11 is increased by the load transmitting member 29 above plate 16, and any tendency of the container 10 to fail because of reduced column strength of wall 11 above plate 16 is obviated by load transmitting member 29.

The construction of the bottom portion of the container 10 is shown by container 10A in FIG. 6. At the bottom of wall 11, outer layer 11A is upwardly folded to provide a flap 44. At the lower end of the intermediate layer 11B of each of the panels of wall 11 is a flap 46, which is preferably of trapezoidal shape; these flaps form the bottom of the container 10. Resting on the bottom flaps 46 is a bottom plate 47 to which the bag 20 will preferably have been attached by adhesive tape (not shown) by the manufacturer.

There has been provided a stackable container which includes a plate for supporting a bag holder, and a portion of the load imposed on the bag, particularly during the filling thereof with fluent material. The column strength of the wall of the container is substantially the same from top to bottom, to enable the container to withstand top to bottom compression forces imposed by the load of a second container stacked on the first mentioned container. The column strength is increased by a force transmitting member which transmits load through the peripheral portion of the support plate into one of more inner layers of the container wall which has or have a height less than that of the outer layer of the container wall.

In addition, there has been provided a subassembly of a bag and a bag holder, held in assembled relationship by an encircling clamp, thereby avoiding the necessity for the assembly of the bag and bag holder by specialized equipment.

Further, there has been provided a container in which an assembled bag and bag holder may be passed transversely through an opening in a plate forming a part of the container, the construction preventing the passage of the ring-like bag holder through the opening in the plate when the ring-like bag holder and the plate are substantially parallel.

The claims and the specification describe the invention presented, and the terms that are employed in the claims draw their meaning from the use of such terms in the specification. Some terms employed in the prior art may be broader in meaning than specifically employed herein. Whenever there is a question between the broader definition of such term as used in the prior art and the more specific us of the term herein, the more specific meaning is meant.

It will be obvious to one skilled in the art that various changes may be made without departure from the spirit and scope of the invention, and therefore the invention is not limited to that shown in the drawings and described in the specification, but only as indicated in the appended claims.

What is claimed is:

1. A container for holding large weights of fluent material and capable of being stacked comprising:

a wall comprising outer and inner layers of corrugated paperboard, the inner layer having a substantially horizontal upper edges, said outer layer having a substantial height above said upper edge of said inner layer, a plate on said upper edge of said inner layer, said plate having a transverse opening therethrough, a bag holder on said plate outwardly of said opening, and extending above said plate a substantial distance, a bag of fluid impervious material in said container having the mouth thereof extending through said opening and attached to said bag holder, said bag holder and said bag extending above said plate not higher than said outer layer, a cap on said wall, engaging said upper edge of said outer layer and overlying said bag holder, means positioned between and engaging said cap and said plate for transmitting a load on said cap of a filled second said container stacked thereon to said upper edge of said inner layer through said plate without significant deformation thereof, said plate comprising means for transmitting said load without significant deformation thereof.

2. The container of claim 1, said load transmitting means comprising a peripherally extending member adjoining the inner surface of said outer layer.

3. The container of claim 2, said load transmitting means having a thickness substantially equal to the thickness of said upper edge.

4. The container of claim 1, said load transmitting means having a thickness substantially equal to the thickness of said upper edge.

5. A container for holding large weights of fluent material and capable of being stacked comprising:

(a) a wall subjected to transverse loads imposed by material within said container and column loads of a second container stacked on said container, said wall comprising an inner layer having an upper edge, (b) a plate on said edge, (c) said wall further comprising an outer layer having a portion extending upwardly beyond said plate, (d) said plate adjoining said outer wall portion, (e) said wall above said plate having substantially reduced column strength in comparison to the column strength of said wall below said edge, and (f) means inwardly of said portion of said outer layer for increasing the column strength of said wall above said plate.

6. The container of claim 5, said means comprising a peripherally extending member above said edge.

7. The container of claim 6, said member having substantially the same thickness as said inner layer.

8. A container for non-gaseous fluent material to be transported therein comprising:

an outer wall, a bottom, a top on said outer wall, a bag within said wall for holding non-gaseous fluent material, said bag having an upper portion including a mouth which defines a filling opening in the top of said bag, said bag having substantially the same size and shape as the interior of said container when said bag is filled with fluent material, and means for supporting the mouth of said bag in open position for enabling filling of said bag with non-gaseous fluent material through said open mouth comprising:

a beam, means for supporting said beam transversely of said container wall below the top of said container, an opening in said beam, said bag upper portion extending through said opening, a ring-like holder independent of said beam on the top of said beam, said ring-like holder having an opening larger than said opening in said beam, and means clamping the mouth portion of said bag to said holder without substantially reducing the size of the filling opening defined by said mouth of said bag and said opening of said ring-like holder comprising a flexible elongate member and means for securing together linearly spaced parts of said elongate member.

9. The assembly of claim 8, said member comprising a strap.

10. The assembly of claim 8, said member being a plastic strap.

11. A container comprising:

a surrounding wall and a liquid impervious bag therein, said bag having a mouth portion and said bag extending downwardly from said mouth portion, a plate having an opening therethrough, means for supporting said plate horizontally in said container near the top thereof, a bag holder comprising a peripherally extending element defining an opening therethrough, said element having a height substantially less than the lateral expanse thereof, means for attaching said mouth portion of said bag to said bag holder, and said plate and said opening including means for enabling said bag holder with said bag mouth portion attached thereto to be passed through said opening when the plate and bag holder are in substantially perpendicular planes, and means for preventing said bag holder from being passed through said opening when substantially parallel to said plate, whereby said bag holder with said bag attached thereto may be passed transversely through said plate, and then moved into a position substantially parallel to said plate, for resting on said plate and for supporting the mouth of said bag holder on said plate.

12. The container of claim 11, said means for enabling comprising one of said bag holder and said opening having a greater dimension in one direction than in a direction transverse to said one direction, and the other of said bag holder and said opening having the largest transverse dimension thereof sufficiently small to permit said transverse passage of said bag holder through said opening of said plate, said means for preventing comprising said largest transverse dimension of said bag holder being sufficiently large to prevent passage of said bag holder through said opening when said bag holder is substantially parallel to said plate.

13. The container of claim 11, wherein said opening is generally circular and said means for enabling comprises a pair of opposed cutouts extending from said circular opening, and wherein said bag holder is annular, the diameter of said bag holder being smaller than the passage provided by said opening and said cutouts together, and larger than said circular opening.

14. A container for fluent material comprising:

an outer wall, an empty bag in said container having an open mouth adjacent the top thereof, and means for supporting the mouth of said empty bag and for preventing said bag from being pulled into said container during filling of said bag comprising:

(a) a beam having a transverse opening therethrough, (b) means for supporting said beam below said top of said container and transversely of said container wall, (c) hanger means for holding the top of the bag, at least parts of said hanger means being larger than said transverse opening and which are on and supported by said beam, said hanger means having an opening therethrough, (d) the mouth of said bag extending upwardly through said transverse opening of said beam and engaging said hanger means, (e) means for clamping said mouth of said empty bag to said hanger means with said mouth in open position without substantially reducing the size of the filling opening defined by said mouth of said bag and said opening of said hanger means comprising a flexible elongate member and means for securing together linearly spaced parts of said elongate member, and (f) cap means for closing said open mouth of said bag, (g) said holding means holding only said bag to said hanger means, whereby said hanger means and said holding means hold open said mouth of said bag prior to and during filling and said cap may close said open mouth of said bag after said bag is filled.

15. The container of claim 14, said member comprising a strap.

16. The container of claim 14, said member being a plastic strap.

* * * * *